US006513693B1

(12) United States Patent
DeLoach

(10) Patent No.: US 6,513,693 B1
(45) Date of Patent: Feb. 4, 2003

(54) ACADEMIC CARRYING APPARATUS

(76) Inventor: Herschel DeLoach, 2697 Granada Cir., St. Petersburg, FL (US) 33712

( * ) Notice: Subject to any disclaimer, the term of this patent is extended or adjusted under 35 U.S.C. 154(b) by 91 days.

(21) Appl. No.: 09/665,097

(22) Filed: Sep. 20, 2000

(51) Int. Cl.[7] ..... A45F 3/04

(52) U.S. Cl. ..... 224/629; 190/114; 190/115; 224/634; 224/645

(58) Field of Search ..... 224/629, 632, 224/634, 645; 190/114, 115, 117, 118, 124; 220/324, 325; 292/145, 147, 148, 175, DIG. 42

(56) References Cited

U.S. PATENT DOCUMENTS 135,254 A * 1/1873 Wallis ..... 224/629 X
3,693,849 A * 9/1972 Knabenbauer ..... 224/629 X
4,793,100 A * 12/1988 Harding et al. ..... 292/147 X
5,628,443 A * 5/1997 Deutsch ..... 224/645 X
6,019,400 A * 2/2000 Prevot et al. ..... 292/145
6,112,959 A * 9/2000 Townsend ..... 224/629 X
6,196,437 B1 * 3/2001 Smith, III ..... 224/629

* cited by examiner

*Primary Examiner*—Gregory M. Vidovich
*Assistant Examiner*—Maerena W. Brevard
(74) *Attorney, Agent, or Firm*—Pendorf & Cutliff

(57) ABSTRACT

An academic carrying apparatus for use in transporting a variety of items over the shoulders with the carrier resting along the user's back. The carrying apparatus has a body portion that defines a storage compartment. The body portion is comprised of a plurality of panels. A lid is coupled to the rear panel and adjacent to an upper peripheral edge of the body portion. The lid has a pair of top latches for coupling with the front panel of the body portion for securing the lid. The rear panel has a pair of strap holders. Finally, the pair of side panels defines a right side panel and a left side panel, with each side panel having a utility portion.

15 Claims, 4 Drawing Sheets

ACADEMIC CARRYING APPARATUS

BACKGROUND OF THE INVENTION

1. Field of the Invention

The present invention relates to an academic carrying apparatus and more particularly pertains to a school supply carrier or backpack for transporting school supplies, books, papers and other items, and wherein the carrier is made of a semi-rigid material.

2. Description of the Related Art

The use of a backpack is known in the prior art. More specifically, back packs heretofore devised and utilized for the purpose of carrying books, clothes, supplies and any other item so chosen by the user are known to consist basically of familiar, expected and obvious structural configurations, notwithstanding the myriad of designs encompassed by the crowded prior art which have been developed for the fulfillment of countless objectives and requirements. The backpack has become not only a popular but healthy way to carry books, papers, clothes, tools and a variety of other items.

In general, an academic carrying apparatus such as a backpack has a pair of shoulder straps by which the bag is suspended from the user's shoulders so as to be carried on the user's back. The back pack, particularly when it is designed for use in carrying school supplies, has a center compartment of a comparatively large internal volume to contain many articles which heavily burdens the user for short periods of time and long periods of time when walking from point "A" to point "B". It is, therefore, desirable that the load is uniformly distributed over the entire area of the user's body, particularly his shoulders, back and waist, and that such a uniform distribution is maintained during movement of the user's body.

Further, most backpacks have a body portion that is hollow and defined by a fabric covering which may be canvas, or synthetic such as a fabric impregnated vinyl, or a pure highly flexible plastic. As used herein, the term "fabric" includes any type of sheet or web material, which may be utilized to define the three-dimensional pack. These fabric bags have certain inherent problems and shortcomings. For example, students traveling between home and school and from one school activity to another school activity during the day typically use the bags. At the end of a school year, the backpack is usually discarded. Many times the backpack does not last the entire school year because the fabric is easily torn and damaged.

By way of example, the prior art includes U.S. Pat. No. 5,255,834, an article carrier that has a carrier body that includes an integral shaped thermoplastic molded three-dimensional graphical display panel to provide distinctive physical appearance and shock-absorbing protective characteristics in use. In accordance with this embodiment, the backpack carrier '834 is provided with an outwardly facing rear panel and bottom panel formed from the shaped three-dimensional graphical display panels. U.S. Pat. No. 5,341,974 describes a back bag such as a backpack, knapsack or a tucksack that has a bottom-equipped bag portion, a pair of shoulder straps provided on the body-contact side of the bag portion. The pack of the '974 patent is adapted to be hung from the user's shoulders, and a hip belt extending from a lower portion of the body-contact side of the bag portion to surround the user's hip bone. The hip belt is made of a left belt and a right belt connected by fastener, so that the hip belt is adjustable in its entire length or its angle of extension.

U.S. Pat. No. 5,236,112 teaches a back bag such as a backpack, knapsack or a rucksack. The back bag has a bottom-equipped bag portion, a pair of shoulder straps provided on the body-contact side of the bag portion and adapted to be hung from the user's shoulders. Further, the back bag has a substantially V-shaped frame provided on the body-contact side of the bag portion. The frame has both wing portions extending from the lower end apex of the V-form located in a region near the lower end of the backbone of the user's body. The wings are elastically deformable independently of each other with respect to the lower end apex of the V-form of the frame. The weight load is distributed over the area of the user's back, as well as the shoulders. The frame is plastically deformable in conformity with the geometry of the user's back, so that the bag portion is held in close contact with the user's back without jumping or slipping sideways during a long-distance walk or climbing.

In U.S. Pat. No. 4,479,595 the backpack has an internal frame. The backpack of the '595 patent consists of a T-shaped stay that has its vertical member centrally positioned to overlie the user's spine. A load-transmitting, flexible, one-point connector extends between the pack bag, at the lower terminus of the frame, and the central rear segment of the hip belt. Stabilizer straps are provided to limit the movement of the pack bag. The one-point flexible connector permits a universal relative movement between the hip belt and the frame and associated pack bag, thereby providing a high level of capacity in the backpack to accommodate the movements of the user. Lastly, U.S. Pat. No. 3,734,365 shows a backpack that has a closure flap with at least one fastening line attached thereto and is engaged on a fastening means attached to the back of the backpack for closing and securing the flap thereof. The fastening means has an elongated body member secured at one end thereof to the backpack, and a post located near the second end of the body member which is secured thereto and to the backpack, with the post and body member forming a pulley-like element with the body member adapted to receive the line and place tension thereon when the line is pulled over the post. An ear protruding from the second end of the elongated body member and extending toward the first end thereof forms a notch with the body member which is adapted to receive and wedge therein the line which holds the flap closed under tension. Thus, there exists a continuing and heretofore unaddressed need for an improved backpack for carrying items for use at school and other activities that is durable with a useful life extending beyond a single academic year or summer. During normal use, the backpack should securely contain all the items needed for the school day or the activities of that day. In addition, it needs to be durable to handle the constant pulling during removal and replacement on the shoulders. The backpack should be reusable and built to last. It should last long past a single school year and last long enough to be used for other purposes. Finally, the backpack should be made of biodegradable material so that, when disposed, it does not adversely impact the environment. It is to the provision of such a container that the present invention is primarily directed.

SUMMARY OF THE INVENTION

The primary object of the present invention is to provide a school-supply carrier or backpack for transporting school supplies, books, papers and other items, and wherein the carrier is made of a semi-rigid material.

Accordingly, the primary users of the academic carrying apparatus are students of all ages and persons wishing to carry a variety of items. Further, the academic carrying apparatus is highly durable and water proof. As such, the general purpose of the present invention will be described subsequently in greater detail.

To attain this, the present invention essentially comprises a body portion that defines a storage compartment that has a front panel, a rear panel and a pair of side panels. A lid is coupled to one portion of the upper peripheral edge of the body portion. The rear panel of the body portion has a pair of straps attached, and at least one outer pocket with a closure flap. Finally, a utensil portion is attached to each of the side panels. There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, of being practiced, and carried out in various ways. In addition, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a backpack style carrier that is formed of a semi-rigid material so that the useful life of pack is increased.

Another object of the present invention is to provide an academic carrying apparatus, which may be easily and efficiently manufactured and marketed.

A further object of the present invention is to provide an academic carrying apparatus, which is made with durable and reliable construction.

An even further object of the present invention is to provide an academic carrying apparatus which is susceptible of a low cost of manufacture with regard to both materials and labor, and which accordingly is then susceptible of low prices of sale to the consuming public, thereby making such carrying apparatus economically available to the buying public.

Still yet, another object of the present invention is to provide a plurality of utensil compartments that are further compartmentalized for improved organization of the utensils.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
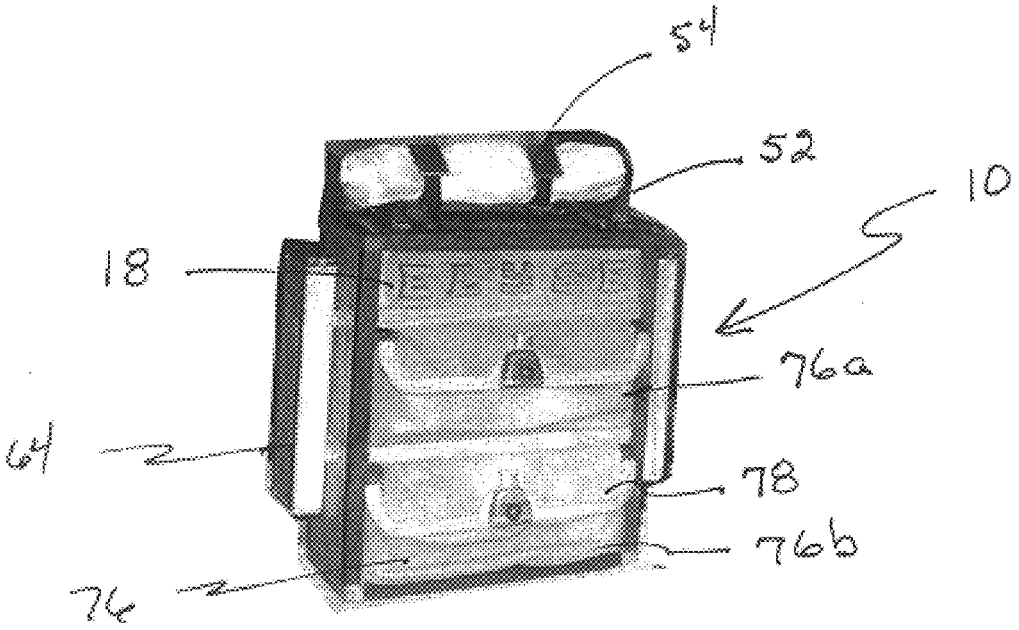
FIG. 1 is a perspective illustration of the preferred embodiment of the academic carrying apparatus constructed in accordance with the principles of the present invention.
Figure 2:
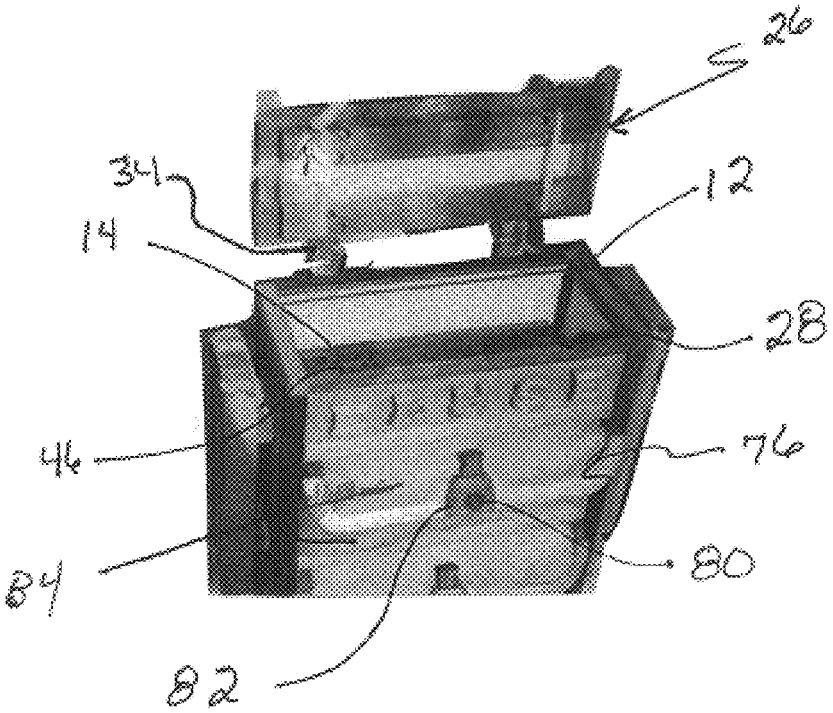
FIG. 2 is a frontal view of the present invention showing the lid in the open position.
Figure 3:
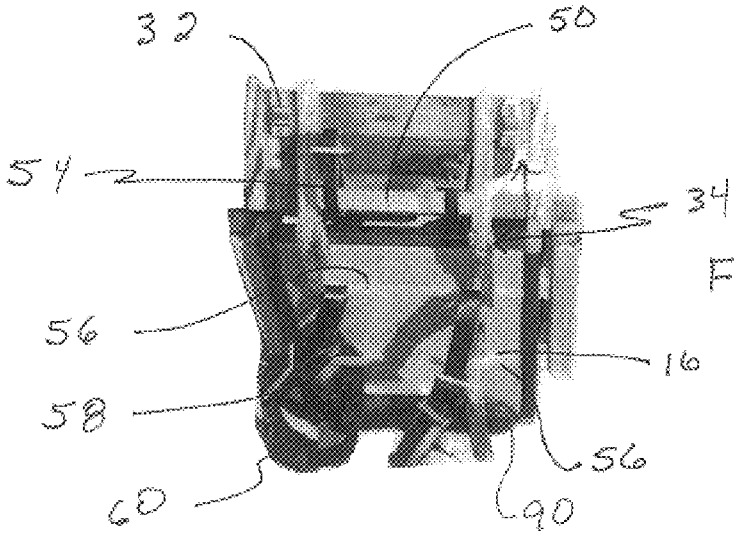
FIG. 3 is a rear view of the present invention of FIG. 1.

With reference now to the drawings, and in particular to FIGS. 1–3 thereof, an academic carrying apparatus embodying the principles and concepts of the present invention and generally designated by the reference numeral 10 will be described.

The present invention, the academic carrying apparatus, is comprised of a plurality of components. Such components in their broadest context include a body portion, a lid, straps and a pair of utility portions. Such components are individually configured and correlated with respect to each other so as to attain the desired objective.

More specifically, the present invention includes a body portion 12 that defines a storage compartment 14. The body portion has a plurality of panels. There is a rear panel 16, a front panel 18, a right side panel 20, and a left side panel 22. The academic carrying apparatus may be formed of wood, plastic, wood and leather, or plastic and vinyl. Preferably, the carrying apparatus is made of plastic and vinyl, with the plastic being a lightweight semi-rigid material. Plastics like PVC (polyvinylchloride plastic or resin pipe) is preferred because of the ease and low cost associated with manufacturing. Other known plastic materials that are suitable for use in forming the carrying case of the present invention are those known as ABS (acrylonitrile-butadiene-styrene plastic), high impact PS (polystyrene plastic), PP (polypropylene plastic or resin), and various other plastics including buterates, acrylics, cellulosics, and acetals.

As shown in FIG. 2, a lid 26 is rotateably coupled to the rear panel. Also, the lid is positioned adjacent to an upper peripheral edge 28 of the body portion. The lid has a pair of top latches 32 that couple to the front panel 18 of the body portion to secure the lid. A pair of hinged members 34 is used to couple the lid to the body portion. Each hinged member has one end coupled to the rear panel and another end coupled to the lid so to allow the lid to cover and uncover the storage compartment.

Figure 8:
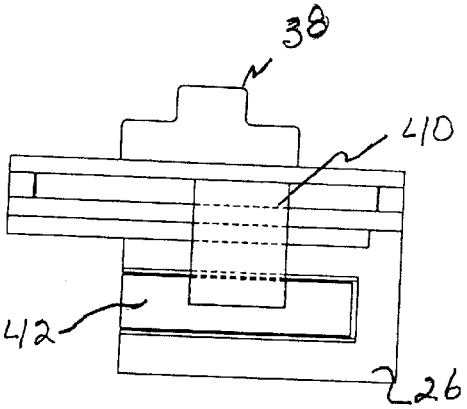
FIG. 8 is a cross-sectional view of the lid fastener in the closed orientation.
Figure 9:
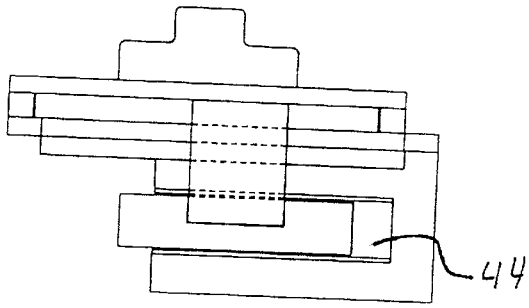
FIG. 9 is a cross-sectional view of the lid fastener in the open orientation.
Figure 10:
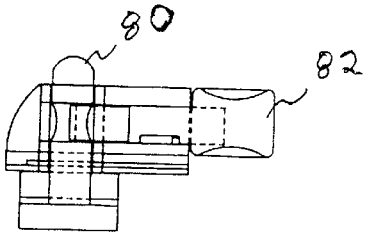
FIG. 10 is a cross-sectional view of the pocket fastener in the closed orientation.
Figure 11:
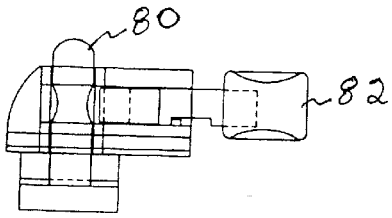
FIG. 11 is a cross-sectional view of the pocket fastener in the open orientation.

As best illustrated in FIGS. 8 and 9, each of the top latches has a latch handle 38 with a vertical member 40 fixedly attached to a slide portion 42. The slide portion is positioned within a channel 44 of the lid. The slide portion moves back and forth within the channel as the latch handle is pushed back and forth. The slide portion is sized to engage a recess 46, as shown in FIG. 2, which is adjacent, an upper peripheral edge of the front panel. When the slide portion engages the recess in a locking position, the lid is positioned over the body portion to cover the storage compartment.

To aid in carrying the apparatus, the lid has a handle portion 50. The handle portion has a pair of slits 52 wherein each is sized to receive a utility strap 54.

The rear panel of the body portion has a pair of strap holders 56. In FIG. 3, an upper and lower strap holder is shown. Each of the strap holders has horizontal slits 58 for receiving a portion of a shoulder strap 60. The right side panel and the left side panel each have a utensil portion mounted thereon. The side panels are designed to carry writing utensils of any type, i.e. pencils, pens, or crayons.

Figure 5:
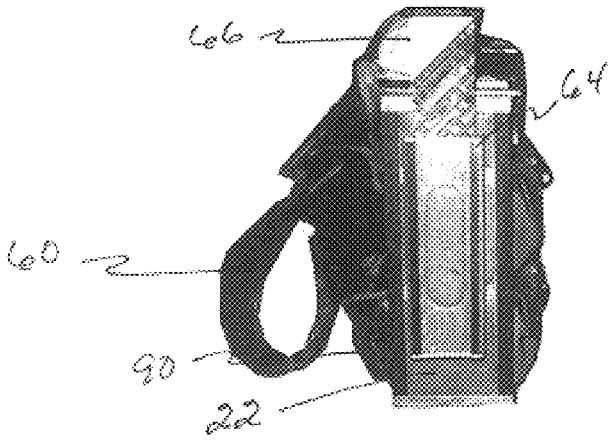
FIG. 5 is a left side view of the present invention having another of the utensil portions in an open orientation.
Figure 4:
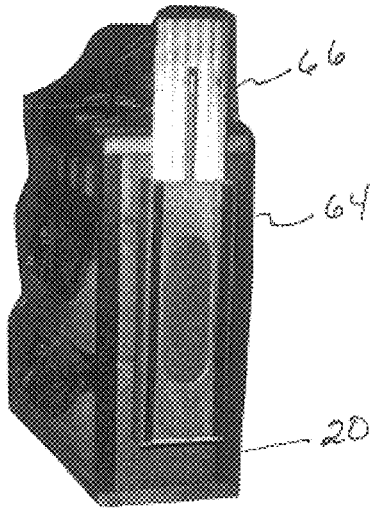
FIG. 4 is a right side view of the present invention having one of the utensil portions in an open orientation.
Figure 6:
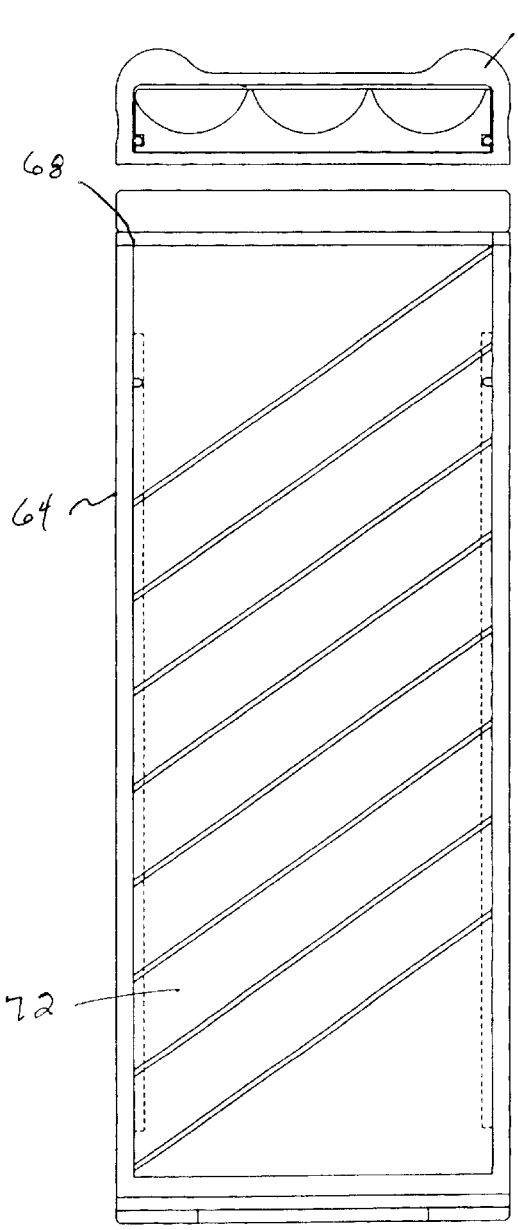
FIG. 6 is a cross-sectional view of the left utensil portion.
Figure 7:
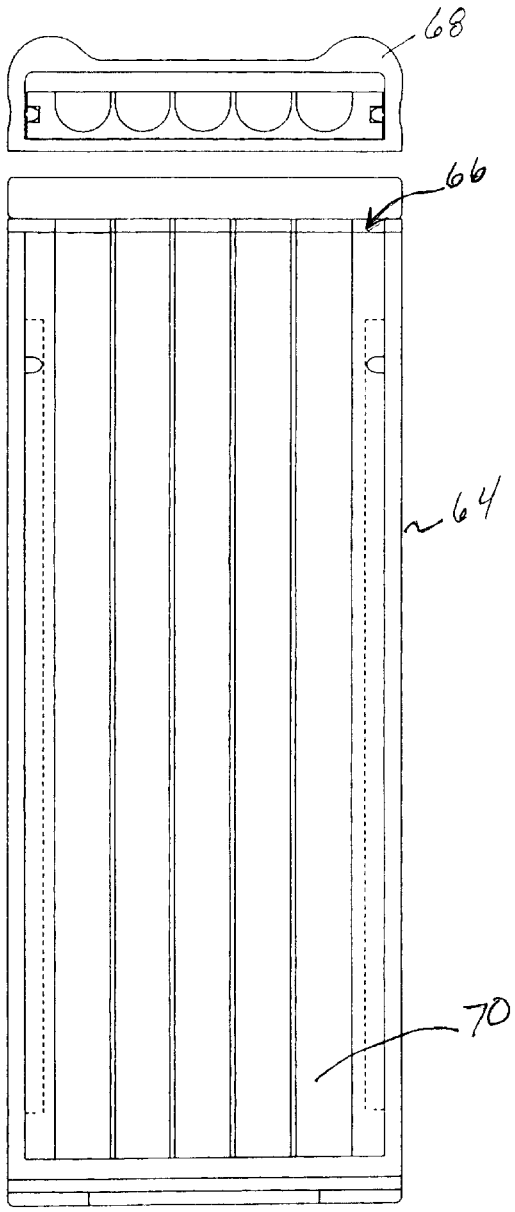
FIG. 7 is a cross-sectional view of the right utensil portion.

As shown in FIGS. 6 and 7, each of the utensil portions has an outer casing 64 sized to slidably receive a vertical member 66. Each vertical member has an upper stop portion 68. One of the vertical members of the utensil portions has a plurality of vertical channels 70, see FIG. 7. The other of the vertical members of the utensil portions has a plurality of angled channels 72, see FIG. 6. The utensils to be placed in the vertical channels can be writing or drawing instruments as shown in FIGS. 4 and 5.

Included on the front panel of the carrying apparatus is at least one outer pocket 76 with a closure flap 78. In the embodiment shown in FIG. 1, two outer pockets are shown; an upper pocket 76*a* and a lower pocket 76*b*. The closure flap of the outer pocket has a fastener means made of a male 80 and female 82 fastener piece. The outer pocket face 84 has a male fastener piece projecting outwardly therefrom, and the closure flap has a female fastener piece. The male fastener piece has a bore 86 for receiving movable stop 88 of the female fastener piece.

Finally, to give more comfort to the user, the rear panel further including a backrest 90 attached below a lower set of strap holders. The backrest may be heavily padded or lightly padded. The padding protects the user's lower back for being rubbed by the semi-rigid material used to make the carrying case.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, equitably entitled.

What is claimed is as follows:

1. An academic carrying apparatus comprising, in combination:

a body portion defining a storage compartment;

the body portion having a plurality of panels defining a rear panel, front panel and a pair of side panels;

a lid rotatably coupled to the rear panel and adjacent to an upper peripheral edge of the body portion, the lid having a pair of top latches for coupling with the front panel of the body portion to secure the lid thereto and each of the top latches has a latch handle with a vertical member fixedly attached to a slide portion, the slide portion is positioned within a channel of the lid, and the slide portion is sized to engage a recess adjacent an upper peripheral edge of the front panel to lockingly position the lid over the body portion;

the rear panel having a pair of strap holders; and the pair of side panels defining a right side panel and a left side panel, with each side panel having a utensil portion mounted thereon.

2. The academic carrying apparatus as set forth in claim 1 wherein a pair of hinged members couple the lid to the body portion, with each hinged member having one end coupled to the rear panel and another end coupled to the lid so to allow the lid to cover and uncover the storage compartment.

3. The academic carrying apparatus as set forth in claim 1 wherein the lid has a handle portion.

4. The academic carrying apparatus as set forth in claim 1 wherein the front panel has at least one outer pocket with a closure flap.

5. The academic carrying apparatus as set forth in claim 4 wherein the closure flap has a fastener.

6. The academic carrying apparatus as set forth in claim 4 wherein an outer pocket face has a male fastener piece projecting outwardly from and the closure flap has a female fastener piece, wherein the male fastener piece has a bore for receiving movable stop of the female fastener piece.

7. The academic carrying apparatus as set forth in claim 1 wherein a strap is positioned through each of the strap holders of the rear panel.

8. The academic carrying apparatus as set forth in claim 1 wherein each of the utility portions has an outer casing sized to slidably receive a vertical member with an upper stop portion.

9. The academic carrying apparatus as set forth in claim 8 wherein one of the vertical members of the utensil portions hash a plurality of vertical channels.

10. The academic carrying apparatus as set forth in claim 8 wherein the other of the vertical members of the utensil portions has a plurality of angled channels.

11. The academic carrying apparatus as set forth in claim 1 is formed of wood.

12. The academic carrying apparatus as set forth in claim 1 is formed of plastic.

13. The academic carrying apparatus as set forth in claim 1 is formed of wood and leather.

14. An academic carrying apparatus comprising, in combination:

a body portion defining a storage compartment;

the body portion having a plurality of panels defining a rear panel, front panel and a pair of side panels;

a lid rotatably coupled to the rear panel and adjacent to an upper peripheral edge of the body portion, the lid having a pair of top latches for coupling with the front panel of the body portion to secure the lid thereto, and the lid has a handle portion, the handle portion includes a pair of slits for receiving utility straps;

the rear panel having a pair of strap holders; and the pair of side panels defining a right side panel and a left side panel, with each side panel having a utensil portion mounted thereon.

15. An academic carrying apparatus comprising, in combination:

a body portion defining a storage compartment;

the body portion having a plurality of panels defining a rear panel, front panel and a pair of side panels;

a lid rotatably coupled to the rear panel and adjacent to an upper peripheral edge of the body portion, the lid having a pair of top latches for coupling with the front panel of the body portion to secure the lid thereto;

the rear panel having a pair of strap holders, and the rear panel further including a backrest attached below a lower set of strap holders; and the pair of side panels defining a right side panel and a left side panel, with each side panel having a utensil portion mounted thereon.

* * * * *